United States Patent [19]

Krippelz

[11] 4,112,599

[45] Sep. 12, 1978

[54] METHOD OF CUSHIONING AND VENTILATING A FOOT, AND FOOTWEAR INCLUDING DISPOSABLE SLIPPERS AND INSOLES FOR PRACTICING SUCH METHOD

[76] Inventor: Jacob Krippelz, 1121 Lebanon St., Aurora, Ill. 60538

[21] Appl. No.: 812,169

[22] Filed: Jul. 1, 1977

[51] Int. Cl.[2] ..... A43B 3/12; A43B 13/38; A43B 7/06

[52] U.S. Cl. ..... 36/11.5; 36/44; 36/3 R

[58] Field of Search ..... 36/3 R, 3 A, 3 B, 11.5, 36/29, 28, 44

[56] References Cited

U.S. PATENT DOCUMENTS

| | | | |
|---|---|---|---|
| 2,074,331 | 3/1937 | Haider | 36/29 X |
| 2,090,881 | 8/1937 | Wilson | 36/29 |
| 2,189,813 | 2/1940 | McGuire | 36/29 X |
| 3,722,113 | 3/1973 | Birkenstock | 36/11.5 |
| 3,785,068 | 1/1974 | Bretschneider | 36/11.5 |

*Primary Examiner*—Patrick D. Lawson

*Attorney, Agent, or Firm*—McCaleb, Lucas & Brugman

[57] ABSTRACT

A method of cushioning and ventilating a foot surface by providing footwear made from a cushioning and ventilating member which constitutes a new use for a known material sometimes called bubble wrap commonly used in shipping rooms for packaging. This material is of laminated construction, consisting of two very thin sheets of non-rubberlike, non-elastic plastics material such as polyethylene heat-sealed together, one of the sheets being formed with a plurality of separate and independent, spaced-apart pockets providing a plurality of independent, closed, individually sealed air cells at atmospheric pressure. Two embodiments of footwear for practicing the invention are disclosed, one being a complete slipper, the other being a separable insole or bottom liner for an existing slipper or shoe. In each case, because the material itself is packaging material, of little value, the footwear is extremely low in cost, cheap enough to be discarded after one use or a few uses, yet strong enough and durable enough for extended use if necessary or desirable.

9 Claims, 15 Drawing Figures

Fig. 7.
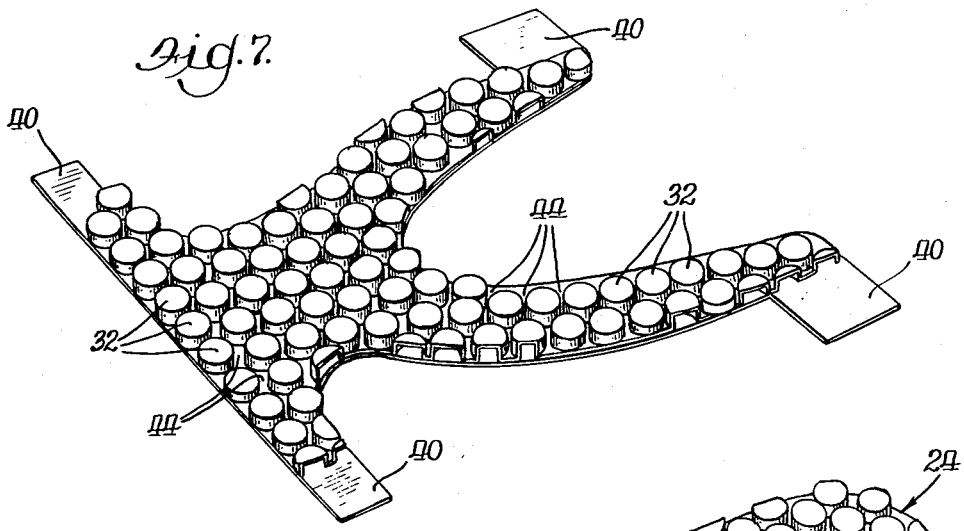
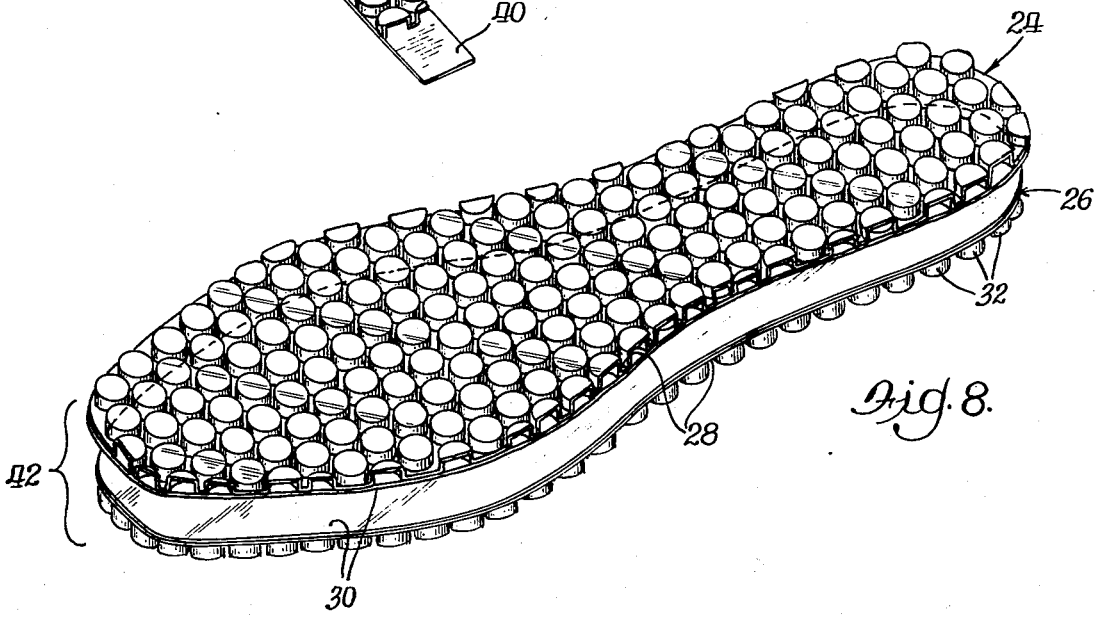
Fig. 8.
Fig. 9.
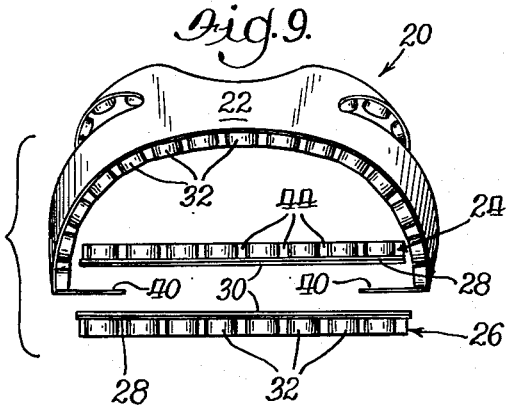
Fig. 10.
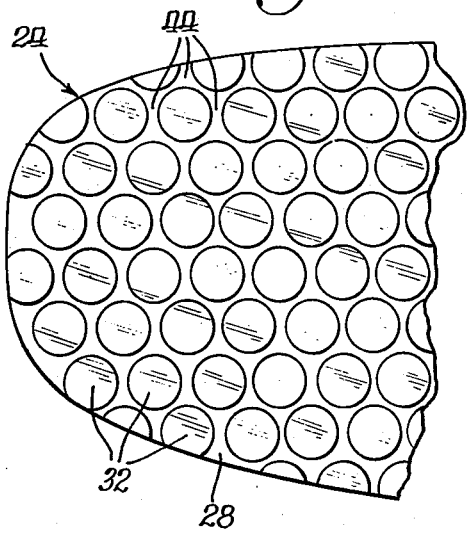

METHOD OF CUSHIONING AND VENTILATING A FOOT, AND FOOTWEAR INCLUDING DISPOSABLE SLIPPERS AND INSOLES FOR PRACTICING SUCH METHOD

CROSS REFERENCE TO RELATED APPLICATIONS

Reference is made to the following co-pending related design patent applications filed by the applicant concurrently with this application:

Ser. No. 812,188; Filed 7-1-77 on SLIPPER

Ser. No. 812,189; Filed 7-1-77 on INSOLE.

BACKGROUND OF THE INVENTION

Footwear such as disposable slippers issued, for example, to patients in hospitals and medical clinics, and insoles for slippers and shoes, have been made from a variety of paperlike and rubberlike materials. These have a number of disadvantages.

Such footwear made from paperlike materials lack durability and wet strength. Rubberlike materials have other disadvantages as described below.

Separable insoles are conventionally made of soft, resilient rubber, either sponge rubber, or soft rubber containing discrete holes or pockets. Some are laminated with additional materials to provide strength but rubber or a rubberlike synthetic is a basic, resilient, elastic component. Examples are shown in Cooney U.S. Pat. No. 1,596,923; Hitzler U.S. Pat. No. 1,869,257; Kelly U.S. Pat. No. 2,007,803; and Wilson U.S. Pat. No. 2,090,881.

Rubber is not very satisfactory for this use, either in disposable slippers, or insoles, because it is by nature basically resilient and elastic and for foot comfort it has been considered necessary to use it in soft grades. In soft grades and thin sections rubber has no useful tensile strength, so it flattens down readily under the pressure of a wearer's foot. If such soft rubber is used for the sole of a disposable slipper, or a separable insole for a permanent shoe, it seals the bottom of the foot and permits very limited ventilation only to the extent that air can pass through the pores of the material. Such prior soles and insoles have no effective provision for the movement of ventilating air freely back and forth across the foot surface. If the rubber has holes, they are closed by the overlying foot, and if the rubber has air pockets, they are flattened. As a result, and despite advertising claims to the contrary, conventional slipper soles and insoles made of rubber or rubberlike resilient materials are not adequate or effective to cushion, ventilate, and cool the feet.

Further, these conventional soles and insoles are expensive. It is not uncommon for ordinary non-name-brand insoles to cost $3.00 or more per pair. The cost creates an incentive for the wearer to keep them far beyond their useful life, causing the feet to heat and perspire under a sort of "plastic raincoat effect" as they cling to the bottom of the feet and restrict air circulation.

SUMMARY OF THE INVENTION

It is a general object of the present invention to provide a method of cushioning and ventilating a foot by using bubble wrap plastics packaging material commonly available in shipping rooms and conventionally employed for wrapping and packaging purposes.

Another object is to provide footwear either in the form of a slipper or an insole from very thin, non-rubberlike, non-elastic plastics material having flexibility, low resilience, low extensibility, and high tensile strength characteristics comparable to polyethylene.

Another object is to provide a method of cushioning and ventilating the bottom surface of a foot by providing a sole or insole having a plurality of separate and independent closed air cells of thin plastics material with coplanar top end walls engaging the bottom of the foot, the closed air cells being numerous enough to distribute the wearer's weight enabling each individual closed air cell to support its share of the wearer's weight with minimal deflection and without exceeding the tensile yield strength of the plastics material itself.

Another object is to provide the sole or insole with spaces between the closed air cells for effective ventilation and to avoid heating and perspiration-dampness sometimes called the "plastic raincoat effect" when rubber or plastics sheet materials are worn close to the skin.

Another object is to provide the sole or insole as described with the top end walls of the closed air cells both flat and coplanar.

Another object is to provide the sole or insole as described with the sidewalls of the closed air cells cylindrical-shaped to maintain their size and shape under the load of a wearer's foot.

Another object is to provide a cushioned, ventilated, disposable slipper made from a pair of soles, plus a strap member, all made from the above described bubble wrap packaging material and all heat-fused together to form a single unit.

BRIEF DESCRIPTION OF THE DRAWINGS

FIGS. 7 and 8 are component parts of the slipper shown in the previous figures, before assembly, FIG. 7 being the strap part, and FIG. 8 being the two sole parts comprising the foot-engaging insole portion and floor-engaging outsole portion;

FIG. 9 is a pre-assembly position of the parts shown in FIGS. 7 and 8, just prior to heat fusing into an integral unit in manufacture;

FIG. 10 is an enlarged fragmentary top view of the insole portion shown in FIG. 8;

Like parts are referred to by like reference characters throughout the figures of the drawings.

DESCRIPTION OF THE PREFERRED EMBODIMENTS

Figure 1:
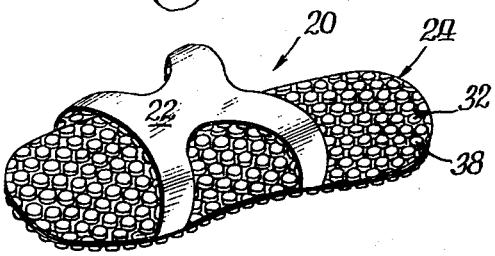
FIG. 1 is a disposable slipper illustrating one form of footwear for carrying out the method of the present invention.
Figure 4:
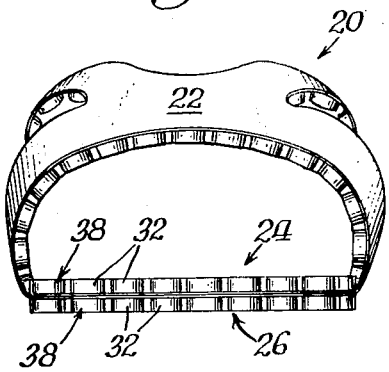
FIGS. 2, 3 and 4 are top, side and front views of the slipper shown in FIG. 1.
Figure 2:
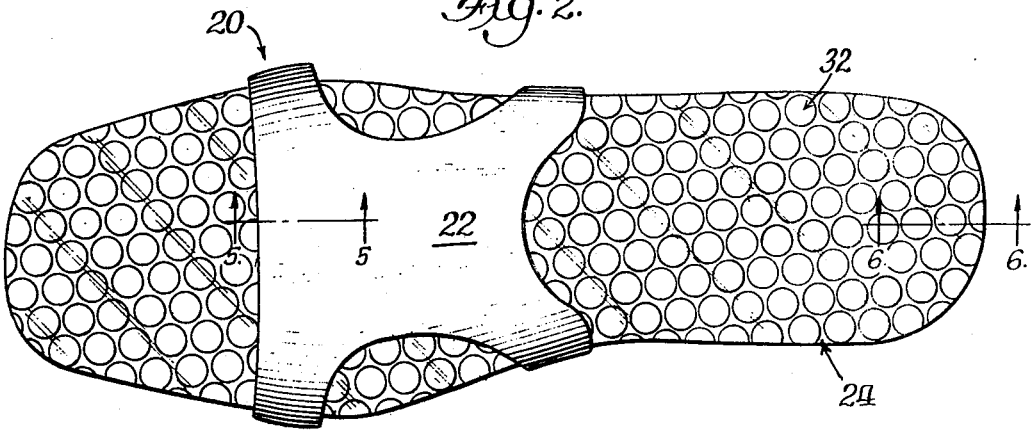
Figure 3:
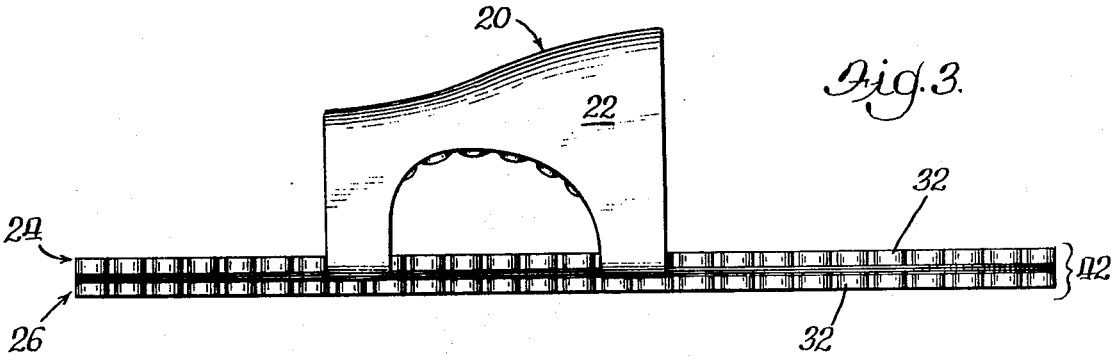

Referring now to the cushioned, ventilated, disposable slipper, this is shown in FIGS. 1–10 and is generally designated 20. It comprises three parts shown unassembled in FIGS. 7 and 8. These are: an arch strap 22; an insole 24 engagable with the bottom of the foot; and an outsole 26 engagable with the floor. In the finished, assembled slipper, the insole 24 and outsole 26 collectively comprise the sole 42.

Figure 5:
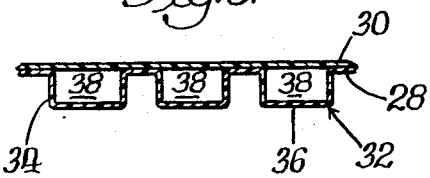
FIGS. 5 and 6 are enlarged, fragmentary, vertical cross-sectional views of FIG. 2 taken along lines 5—5 and 6—6 respectively.
Figure 6:
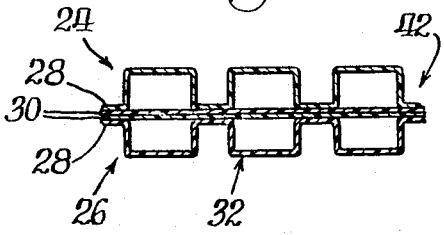
Figure 11:
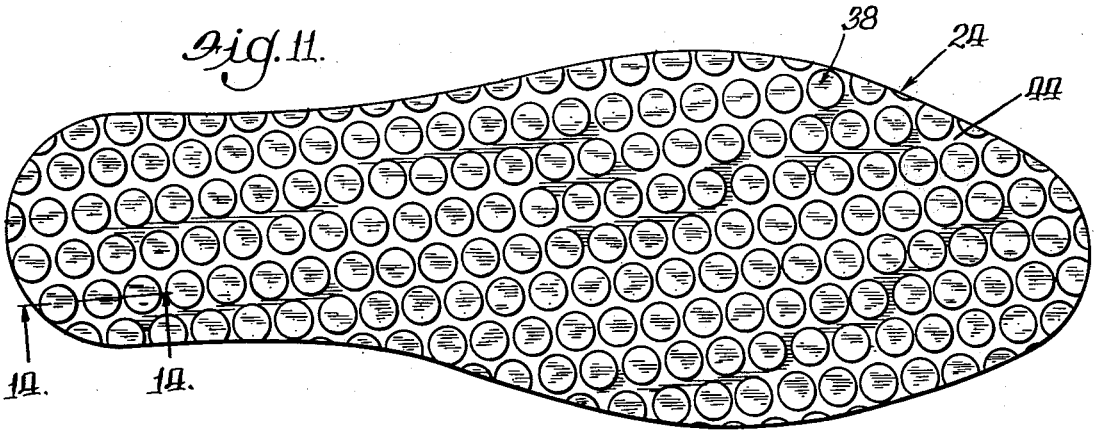
FIG. 11 is a top plan view of a separable insole illustrating another form of footwear for carrying out the method of the present invention.
Figure 12:
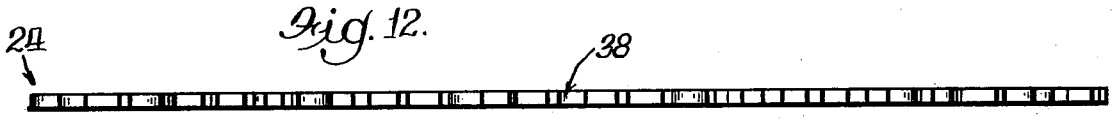
FIGS. 12 and 13 are side and bottom views respectively of the insole shown in FIG. 11.
Figure 13:
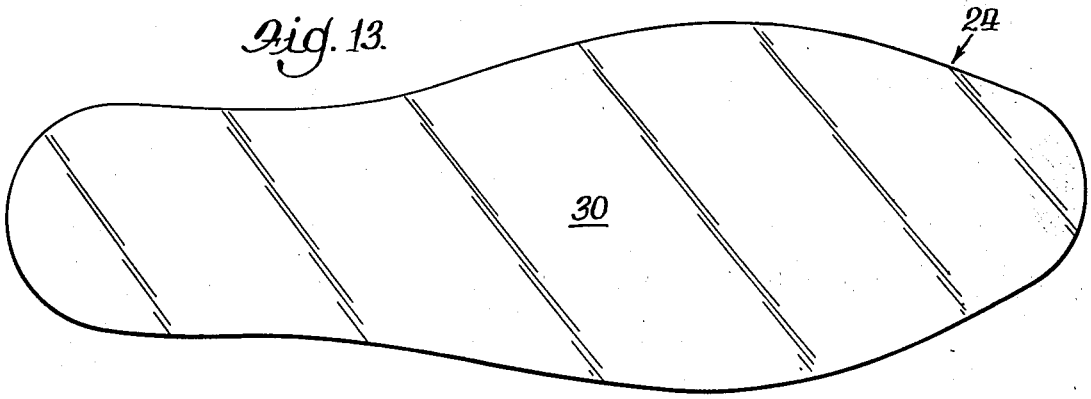
Figure 14:
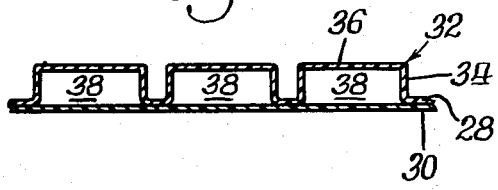
FIG. 14 is an enlarged fragmentary vertical sectional view of FIG. 11 taken along line 14—14.

In manufacture, the parts are cut to the shapes shown from rolls of bubble wrap packaging sheet. Referring to FIGS. 5 and 14, this material is of laminated construction consisting of a cushioning sheet 28 and a web sheet 30, both of non-rubberlike, non-elastic plastics material, preferably polethylene. The cushioning sheet 28 is formed with a plurality of separate and independent pockets 32 having cylindrical side walls 34 of uniform depth and diameter, all extending in the same direction from the web sheet and having substantially coplanar top end walls 36. The web sheet is sealed against the concave side of the cushioning sheet to close the open ends of the pockets and thereby provide a plurality of independent, closed air cells 38 with air sealed within them at atmospheric pressure.

One particular bubble wrap sheet material with which I have had considerable success in making the footwear described is made from polyethylene plastics film, the sheets 28 and 30 being approximately 1.5 mils (0.0015 inch) thick. The pockets 32 are approximately $\frac{3}{8}$ inch diameter and the cylindrical walls 34 are approximately $\frac{1}{8}$ inch high. The minimum spacing between individual pockets is about 1/16 inch, enabling unrestricted ventilating movement of air back and forth across the foot surface supported or engaged thereby.

The insole 24, for a size 10 man's slipper or shoe has approximately 130 individual closed air cells 38. For a 170 lb. man, with his entire weight supported on one insole, the weight is thus distributed, averaging 1.3 lbs. per closed air cell 38. The total area of all the top ends 36 (these are shown at the bottom in FIG. 5) is 14.4 square inches, providing an average pressure increase within each cell of only 11 lbs. per square inche when the full weight of the wearer is applied to one insole. This is well within the strength limits of the polyethylene plastics film material employed. This may be selected from a variety of thicknesses ranging from about 0.5 to 3.0 mils.

The cylindrical shape of the air cells 38, and their flat top ends enable them to maintain their shape and size under pressure applied by the wearer's foot. In manufacturing the disposable slipper 20, the arch strap 22 is punched or cut to the shape shown in FIG. 7 and tabs 40 are produced between a pair of heated platens in a conventional press (not shown) which flattens and fuses the cushioning and web sheets 20 into a single piece. This combines the thicknesses of the two original sheets.

The sole 42 is made by punching or cutting from the bubble wrap material the insole 24 and outsole 26, both having identical shapes in plan view except that the air cells 38 preferably face upwardly on the insole to engage the bottom of the foot, and face downwardly on the outsole to engage the floor. Alternatively, this arrangement may be reversed for the outsole 26 so that the relatively smooth web sheet 30 engages the floor.

By bending the tabs 40 inwardly and placing the parts in the relative positions shown in FIG. 9, the tabs 40 can be readily fused and adhered to the insole 24 and outsole 26 by a conventional heated-platen press (not shown).

Referring now to the embodiment shown in FIGS. 11–14, this is a separate insole intended for use as a removable item in a permanent shoe. It is illustrated as identical to the insole 24 shown and described as part of the slipper 20, so it has the same reference numerals. In actual use, this insole is positioned in the shoe with the air cells 38 facing upwardly to engage the bottom of the wearer's foot. As described for the sole 42 above, the insole 24 has approximately 130 cells 38 with the same shape and dimensions as described for the slipper 20. This easily supports a 170 lb. man with his weight distributed over the cells, relieving the underside of the foot completely from any contact whatsoever with the relatively hard sole of any shoe within which it is worn. The foot is free to shift, spread and contract slightly in all directions as the air cells 38 flex and bend with normal walking movements, giving a very comfortable "walking on air" sensation. In addition, the spaces 44 between the air cells, extending completely from one end of the foot to the other and from side to side, keep it ventilated, cool and dry. Notwithstanding the fact that the polyethylene material is only a few thousandths of an inch thick, it is capable of maintaining the shape and size of the air cells intact to support the foot as described because this material is basically different from rubber conventionally used in insoles. Because rubber is resilient and elastic by nature, it mashes down flat under the wearer's weight if used in such thin sections as described for the present invention. By contrast, polethylene and related plastics materials, while flexible, are non-resilient and non-elastic, and will not stretch to any significant extent under this kind of use. Despite the fact that the insole 24 easily supports a 170 lb. man, it is featherlight, weighing only 5 grams, barely enough to move the pointer on a postage scale. And the cost, fully manufactured and ready to sell, is so cheap, for both the disposable slipper 20 and the separate insole 24 that they can be sold in multiple lots, used for only a few days, and discarded. Yet the material is so strong and durable that, if necessary or desirable, they can be worn for extended periods and will retain their effectiveness.

The low cost of both the disposable slipper and insole makes possible a medical use, namely they can be issued to patients in hospitals to be discarded by the patient on discharge.

Both the individual insoles 24 and the slippers 20 may be manufactured in quantity simply by punching them out from large sheets of the laminated bubble wrap material. This ruptures a few of the air cells 38 around the edges, as is clearly evident in some of the drawings, but this does not interfere in any way with their effectiveness because there are so many unruptured cells left to support the load.

Figure 15:
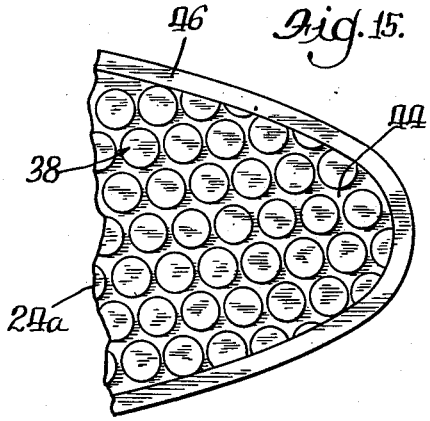
FIG. 15 is a fragmentary view similar to FIG. 11 showing an alternate embodiment of the insole.

Alternatively, the insoles may be cut by use of a hot-edged die, or may be edged fused after cutting, to provide a smooth, peripheral, fused edge 46 as shown in FIG. 15 for an alternate form of insole **24*a* which is otherwise identical to the one shown in FIGS. 11–14**.

While two embodiments of footwear for practicing the method of the present invention have been shown and described, one being a disposable slipper, and the other being a removable insole for permanent shoes, it will be understood that various modifications in construction and application may be made within the spirit and scope of the present invention. The invention therefore should be limited only by the appended claims.

I claim:

1. In the method of cushioning and ventilating a foot, the improvement which comprises placing a cushioning and ventilating member against a foot surface;

the cushioning and ventilating member being of laminated construction consisting of a cushioning sheet and a web sheet both of non-rubberlike plastics material having flexibility, low resilience, low extensibility, and high tensile strength characteristics comparable to polyethylene;

the cushioning sheet being formed with a plurality of separate and independent pockets of uniform depth having sidewalls extending in one direction from the web sheet toward the foot surface and having substantially coplanar top end walls engaging the foot surface;

the web sheet being sealed against the concave side of the cushioning sheet to close the open ends of the pockets to provide a plurality of independent, closed air cells with air sealed at atmospheric pressure therein;

said air cells having spaces between them enabling free circulation of air in said spaces while the foot surface is engaged with the top end walls of the pockets;

the material of said cushioning sheet being sufficiently thin and flexible that the normal weight of a person applied to said cushioning and ventilating member through said foot surface causes said top end walls of said pockets to lend themselves fleixbly, conformably, and flatwise to said foot surface.

2. In the method of cushioning and ventilating a foot, the improvement as defined in claim 1 in which the top end walls of the pockets are substantially flat.

3. In the method of cushioning and ventilating a foot, the improvement as defined in claim 1 in which the side-walls of the pockets are cylindrically shaped with substantially flat top end walls whereby to maintain their shape and size under pessure from the foot surface.

4. In the method of cushioning and ventilating a foot, the improvement as defined in claim 1 in which the plastics material of which the cushioning and web sheets are made is from 0.5 to 3.0 mils thick, the closed air cells are cylindrical-shaped with a diameter of approximately $\frac{3}{8}$ inch diameter and $\frac{1}{8}$ inch depth, and the spaces between sidewalls of adjacent air cells are approximately 1/16 inch.

5. In the method of cushioning and ventilating a foot, the improvement as defined in claim 1 in which the cushioning and ventilating member is formed corresponding to the bottom of the foot and is placed in a wearer's shoe for use as an insole.

6. In the method of cushioning and ventilating a foot, the improvement as defined in claim 1 including the steps of:

(a) forming said cushioning and ventilating member in two parts each in the shape of the sole of a slipper, and a third part in the shape of the arch of a slipper with tab means at opposite sides;

(b) inserting said tab means between the two sole-shaped parts and adhering said tab means thereto; and (c) placing the resulting assembly on a foot and wearing same as a slipper.

7. A cushioned, ventilated, disposable slipper comprising inner and outer soles and an arch strap made from a laminated cushioning and ventilating member consisting of a cushioning sheet and a web sheet both of non-rubberlike plastics material having flexibility, low resilience, low extensibility, and high tensile strength characteristics comparable to polyethylene;

the cushioning sheet being formed with a plurality of separate and independent pockets of uniform depth having concave and convex sides with sidewalls extending from the convex side and having substantially coplanar top end walls; the web sheet being sealed against the concave side of the cushioning sheet to close the open ends of the pockets to provide a plurality of independent, closed air cells with air sealed at atmospheric pressure therein, said air cells having spaces between them enabling free circulation of air therein;

said inner and outer soles being shaped to conform to the bottom of a foot and adhered to one another in back-to-back laminated relationship; and said arch strap being shaped to conform to the upper arch surface of a foot and having tab means at opposite sides inserted between and adhered respectively to said soles.

8. A cushioned, ventilated, disposable slipper as defined in claim 7 in which the top end walls of the pockets of at least the inner sole are oriented to face and contact foot surfaces to provide cushioning and ventilation therealong.

9. A cushioned, ventilated, disposable slipper as defined in claim 7 in which the top end walls of the pockets of the inner sole and of the arch strap are oriented to face and contact a foot to provide cushioning and ventilation along all foot surfaces contacted by the slipper.

* * * * *